US011938413B1

(12) United States Patent
Minsky et al.

(10) Patent No.: US 11,938,413 B1
(45) Date of Patent: Mar. 26, 2024

(54) SCENTED TOY

(71) Applicants: Nina Minsky, Port Orchard, WA (US); Jonathan Contreras, Port Orchard, WA (US)

(72) Inventors: Nina Minsky, Port Orchard, WA (US); Jonathan Contreras, Port Orchard, WA (US)

( * ) Notice: Subject to any disclaimer, the term of this patent is extended or adjusted under 35 U.S.C. 154(b) by 0 days.

(21) Appl. No.: 17/549,616

(22) Filed: Dec. 13, 2021

Related U.S. Application Data

(60) Provisional application No. 63/124,847, filed on Dec. 13, 2020.

(51) Int. Cl.
*A63H 9/00* (2006.01)
*A63H 3/36* (2006.01)

(52) U.S. Cl.
CPC ..... *A63H 3/36* (2013.01); *A63H 9/00* (2013.01)

(58) Field of Classification Search
CPC ..... A63H 3/00–48; A61L 9/12; A61L 9/013; A61L 9/014; A61L 9/042; A45D 34/00; A45D 34/02
USPC ..... 422/5, 124, 125; D21/596–657
See application file for complete search history.

(56) References Cited

U.S. PATENT DOCUMENTS 1,767,911 A * 6/1930 Berko ..... B05B 11/06 239/362
2,618,892 A * 11/1952 Locks ..... A63H 33/28 446/268
3,955,314 A * 5/1976 Robb ..... A61J 17/1111 446/72
4,534,509 A * 8/1985 Holzner ..... B65D 81/3272 239/34
4,858,831 A * 8/1989 Spector ..... A61L 9/12 239/326
4,889,284 A * 12/1989 Spector ..... A61L 9/12 239/34
5,037,343 A * 8/1991 Benites ..... A63H 3/003 428/905
5,254,028 A * 10/1993 Liao ..... F41H 9/10 446/297
5,577,947 A * 11/1996 Malloy ..... A63H 27/10 446/385

(Continued)

FOREIGN PATENT DOCUMENTS

DE 10 2017 205 070 A1 * 9/2018 ..... A61L 9/12

OTHER PUBLICATIONS

Bosch, Machine translation of DE102017205070 A1, uploaded Jun. 28, 2023, Espacement, 8 pages.*

*Primary Examiner* — Eugene L Kim
*Assistant Examiner* — Matthew B Stanczak
(74) *Attorney, Agent, or Firm* — Ashkan Najafi

(57) ABSTRACT

A scented toy includes a three-dimensional body having a portable, squishy, micro-porous core impregnated with a plurality of fragrances as well as a muffin-shaped profile, a fruit-attachment impregnated with a first fragrance of the plurality of fragrances, an ear-attachment impregnated with a second fragrance of the plurality of fragrances, a face section communicatively coupled to the core and connected to the fruit-attachment and the ear-attachment wherein the face section is configured to emit a third fragrance when squeezed. The third fragrance is a mixture of the first fragrance and the second fragrance. Each of the fruit-attachment, the ear-attachment, and the face section is deformably resilient.

14 Claims, 7 Drawing Sheets

(56) References Cited

U.S. PATENT DOCUMENTS 5,676,583 A * 10/1997 Wang ..... A63H 3/00 446/268
6,012,963 A * 1/2000 Lee ..... A63H 3/36 428/905
6,089,947 A * 7/2000 Green ..... A63H 3/003 446/268
D437,367 S * 2/2001 Wang ..... D21/596
6,193,577 B1 * 2/2001 Kaplan ..... A61N 2/002 446/72
6,520,826 B2 * 2/2003 Spector ..... A63H 3/001 446/72
6,699,090 B1 * 3/2004 Vick ..... A61L 9/12 446/73
6,749,479 B2 * 6/2004 Vick ..... A61L 9/12 446/72
6,800,015 B1 * 10/2004 Derges ..... A61L 9/042 239/211
6,840,197 B1 * 1/2005 Trompke ..... A01K 15/02 119/711
8,408,481 B1 * 4/2013 Priest ..... A61L 9/12 239/71
D682,366 S * 5/2013 Perez ..... D21/604
9,125,396 B1 * 9/2015 Ripka ..... A01M 1/2055
9,370,593 B2 * 6/2016 Newman ..... A61L 9/032
D839,364 S * 1/2019 Cooks ..... D21/628
10,987,599 B1 * 4/2021 Fazio ..... A63H 3/50
11,324,848 B2 * 5/2022 Roszell ..... A61L 9/014
2002/0123295 A1 * 9/2002 Spector ..... A63H 3/001 446/268
2003/0068955 A1 * 4/2003 Vick ..... A63H 3/02 446/369
2003/0224692 A1 * 12/2003 Hidalgo ..... A63H 3/02 446/369
2004/0000596 A1 * 1/2004 Cuthbert ..... A45D 40/0087 239/34
2004/0000599 A1 * 1/2004 Cuthbert ..... A61L 9/042 239/327
2005/0214488 A1 * 9/2005 Ishida ..... B68G 1/00 428/34.1
2005/0287912 A1 * 12/2005 Yu ..... A63H 3/02 446/369
2006/0062700 A1 * 3/2006 Hurwitz ..... A61L 9/12 422/123
2006/0222560 A1 * 10/2006 Stanley, III ..... A61L 9/12 422/5
2008/0168992 A1 * 7/2008 Spector ..... A61L 9/145 128/207.18
2009/0162253 A1 * 6/2009 Porchia ..... A61L 9/02 422/124
2011/0049259 A1 * 3/2011 Beland ..... A61L 9/037 239/7
2012/0028532 A1 * 2/2012 Thompson ..... A63H 3/02 446/73
2012/0108888 A1 * 5/2012 Spector ..... A61L 9/12 600/27
2013/0217301 A1 * 8/2013 Cote ..... A63H 9/00 446/490
2017/0028304 A1 * 2/2017 Stray ..... A63H 3/005
2017/0246549 A1 * 8/2017 Zhu ..... B44C 5/005
2019/0125915 A1 * 5/2019 Roszell ..... A61L 9/014
2022/0192339 A1 * 6/2022 Rotundo ..... A63H 33/00

* cited by examiner

SCENTED TOY

CROSS REFERENCE TO RELATED APPLICATIONS

This is a non-provisional patent application that claims priority to and benefit of U.S. provisional patent application No. 63/124,847 filed Dec. 13, 2020, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to toys and, more particularly, to a specially designed fragrance emitting toy.

Prior Art

Stuffed, soft bodied animal and personage characters have long been a favorite toy for young children. These play toys are readily huggable and have a comforting effect on the children. These toys typically are manufactured from fabric materials that is cut and attached together to define bodies with various appropriate appendages. The bodies are then filled with various stuffing materials, typically soft, but firm materials are used as well. The characters often are popularly known cartoon or other characters, as well as replicas of animals and the like.

These stuffed animal and personage characters are held, played with, and otherwise used in many different locations, but generally at the home of the owner of the toy. It is to be appreciated that these various environments have differing smells and odors. Often persons attempt to modify or control the odors, and there are a variety of devices directed to such. Further, it is believed that persons may be helped in attitude and comfort if the odors in their environment are pleasing and satisfactory rather than unpleasant or disturbing. Known scenting devices have not been entirely successful in being incorporated with articles such as toys to provide a favorable fragrance in their various environments.

Accordingly, a need remains for a fragrance emitting toy in order to overcome at least one of the above-noted shortcomings. The exemplary embodiment(s) satisfy such a need by a scented toy that is convenient and easy to use, lightweight yet durable in design, versatile in its applications, and designed to provide a toy configured to emit a favorable fragrance.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a scented toy for emitting an aromatic scent. These and other objects, features, and advantages of the non-limiting exemplary embodiment(s) are provided by a scented toy including a three-dimensional body having a portable, squishy, micro-porous core impregnated with a plurality of fragrances as well as a muffin-shaped profile. The body further has a fruit-attachment communicatively coupled to the core wherein the fruit-attachment is impregnated with a first fragrance of the plurality of fragrances. Advantageously, the fruit-attachment is configured to emit the first fragrance when squeezed. The body further has an ear-attachment communicatively coupled to the core and spaced apart from the fruit-attachment wherein the ear-attachment is impregnated with a second fragrance of the plurality of fragrances. Advantageously, the ear attachment is configured to emit the second fragrance when squeezed. The body further has a face section communicatively coupled to the core and connected to the fruit-attachment and the ear-attachment wherein the face section is configured to emit a third fragrance when squeezed. Advantageously, the third fragrance is a mixture of the first fragrance and the second fragrance. Notably, each of the fruit-attachment, the ear-attachment, and the face section is deformably resilient.

In a non-limiting exemplary embodiment, the first fragrance is associated with a fruit scent corresponding to the fruit-attachment.

In a non-limiting exemplary embodiment, the body further includes a plurality of paws communicatively coupled to the core and spaced apart from the fruit-attachment, and the ear-attachment. Advantageously, the plurality of deformably resilient paws are impregnated with a fourth fragrance of the plurality of fragrances. Such a plurality of paws are deformably resilient and configured to emit the fourth fragrance when squeezed.

In a non-limiting exemplary embodiment, the body further includes a tail communicatively coupled to the core and spaced apart from the fruit-attachment, the ear-attachment, and the paws. Advantageously, the tail is impregnated with a fifth fragrance of the plurality of fragrances, and is deformably resilient and configured to emit the fifth fragrance when squeezed.

In a non-limiting exemplary embodiment, the body further has a plurality of travel paths extending from the fruit-attachment, the ear-attachment, the paws, and the tail to the face section. Advantageously, the travel paths are configured to displace the first fragrance, the second fragrance, the fourth fragrance, and the fifth fragrance towards the face section for emitting the third fragrance therefrom. Such travel paths may pass through the core and are mutually exclusive and non-overlapping such that the fragrances are not mixed prior to reaching the face section.

In a non-limiting exemplary embodiment, the second fragrance is associated with a non-fruit scent corresponding to the ear-attachment.

In a non-limiting exemplary embodiment, each of the first fragrance, the second fragrance, the fourth fragrance, and the fifth fragrance has a unique aroma. In this manner, the mixed fragrance further includes the fourth fragrance and the fifth fragrance.

In a non-limiting exemplary embodiment, an alternate mechanism for discharging the fragrances may be accomplished by the following structure. The body includes a plurality of panels in communication with the porous body, and a deformably resilient mesh screen layer communicatively coupled to the panels, the fruit-attachment, the ear-attachment, the face, the paws, and the tail. Such a deformably resilient mesh screen layer may be wrapped about the core and is configured to be stretched to a tension position and released to an equilibrium position, respectively. Advantageously, the panels are attached to the mesh screen layer and configured to be selectively opened and closed, respectively, when the deformably resilient mesh screen layer is stretched to the tension position and released to the equilibrium position, respectively. Advantageously, the plurality of fragrances are configured to be released and retained via the panels, respectively, when toggled to the open position and the closed position, respectively.

The present disclosure further includes a method of emitting an aromatic scent from a scented toy. Such a method includes the chronological steps of: providing a three-dimensional body including a portable, squishy, micro-porous core impregnated with a plurality of fragrances, wherein the body has a muffin-shaped profile; providing and communicatively coupling a fruit-attachment to the core; providing and communicatively coupling an ear-attachment to the core; spacing apart the ear-attachment from the fruit-attachment; providing and communicatively coupling a face section to the core; and connecting the face section to the fruit-attachment and the ear-attachment.

The method further includes the chronological steps of: impregnating the fruit-attachment with a first fragrance of the plurality of fragrances; squeezing the fruit-attachment and thereby emitting the first fragrance; impregnating the ear-attachment with a second fragrance of the plurality of fragrances; squeezing the ear attachment and thereby emitting the second fragrance; and squeezing the face section and emitting a third fragrance. Advantageously, the third fragrance is a mixture of the first fragrance and the second fragrance, and each of the fruit-attachment, the ear-attachment, and the face section is deformably resilient.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
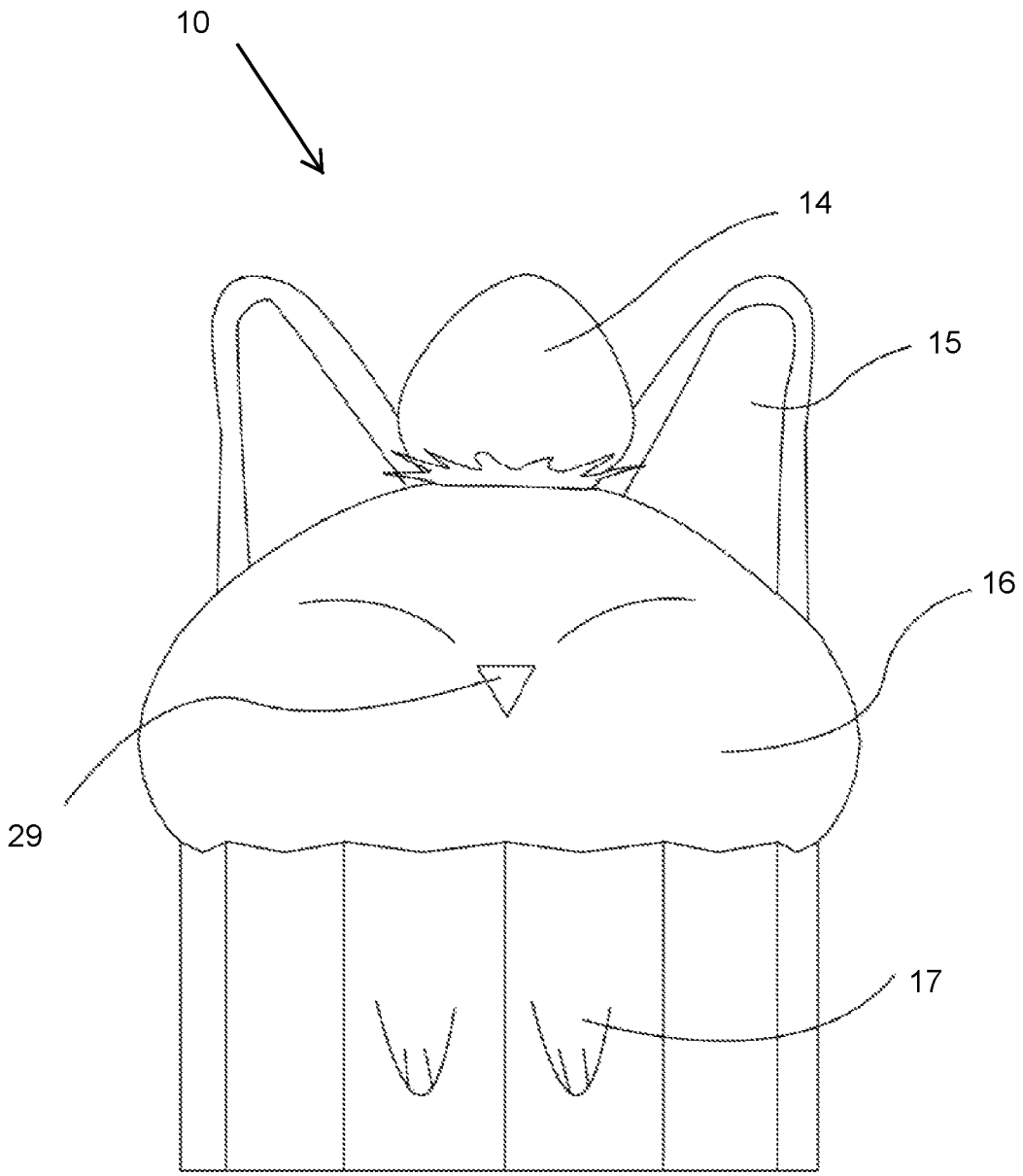
FIG. 1 is a front view of a scented toy according to an embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about," "generally," and "approximately" mean nearly and in the context of a numerical value or range set forth means±15% of the numerical.

If used herein, "substantially" means largely if not wholly that which is specified but so close that the difference is insignificant.

Figure 2:
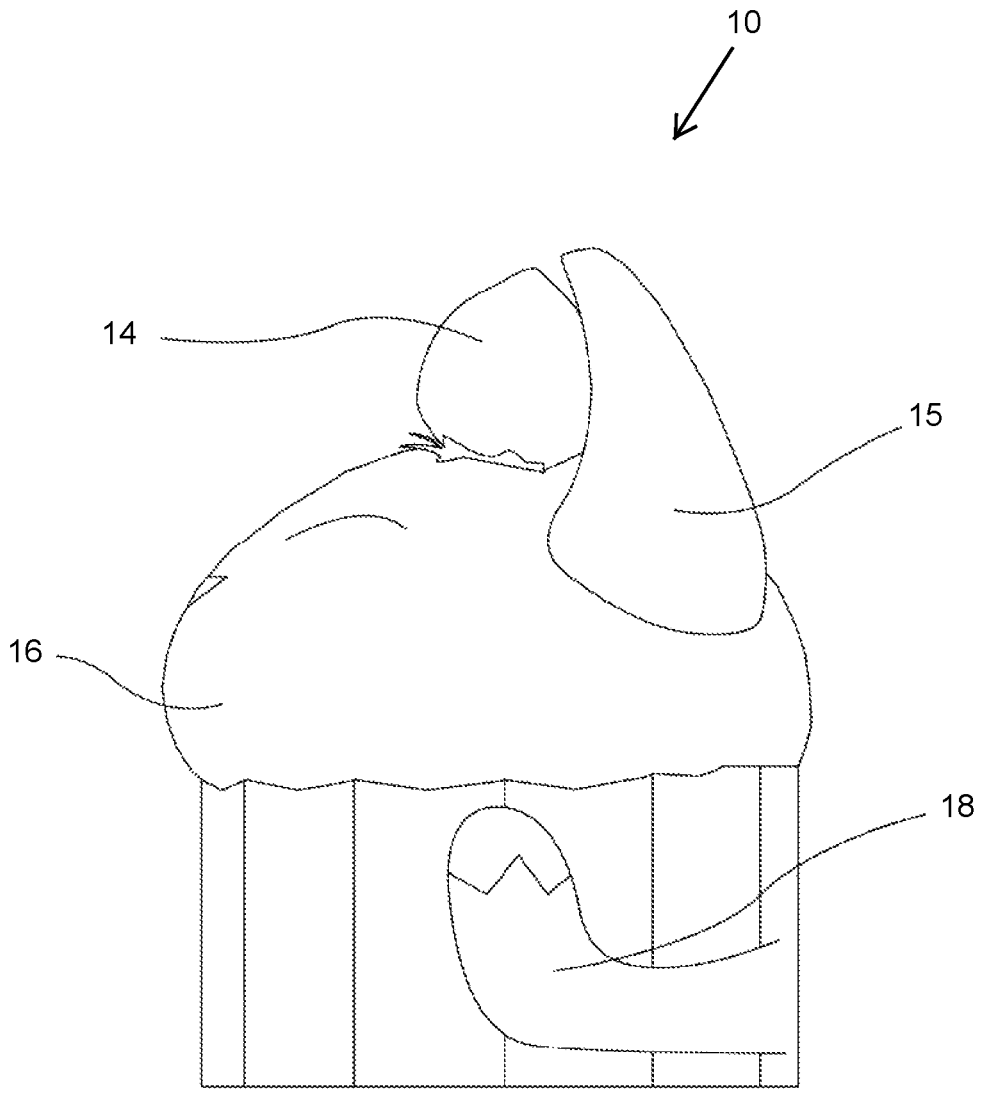
FIG. 2 is a side view of a scented toy according to an embodiment of the present disclosure.
Figure 3:
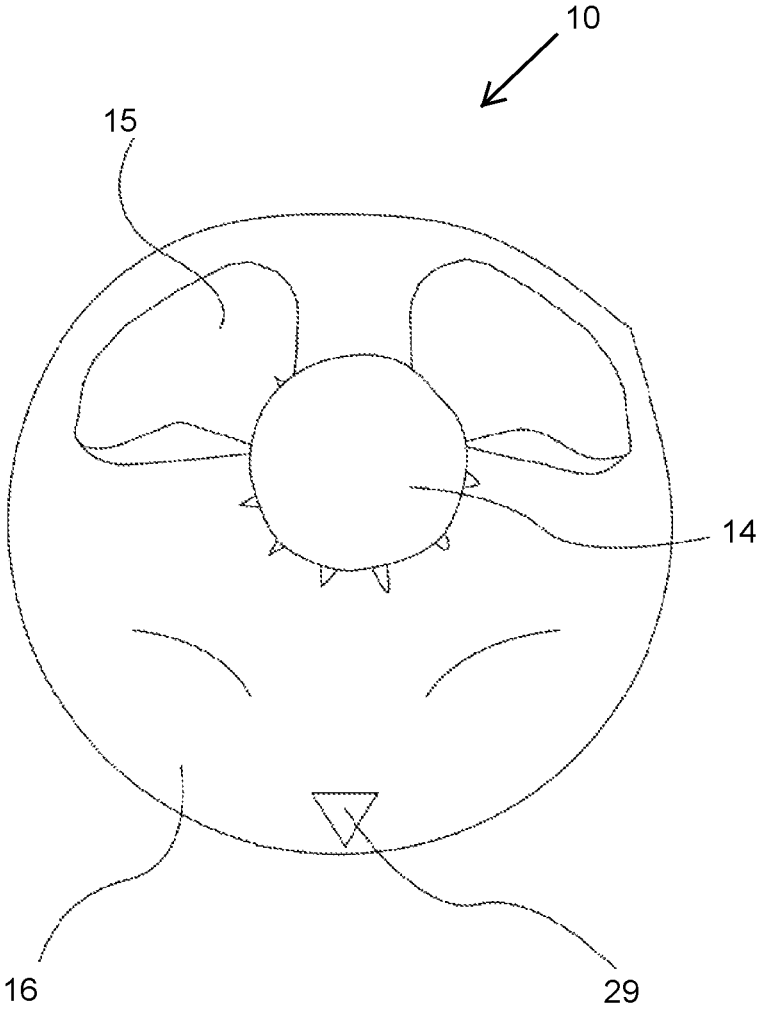
FIG. 3 is a top view of a scented toy according to an embodiment of the present disclosure.
Figure 4:
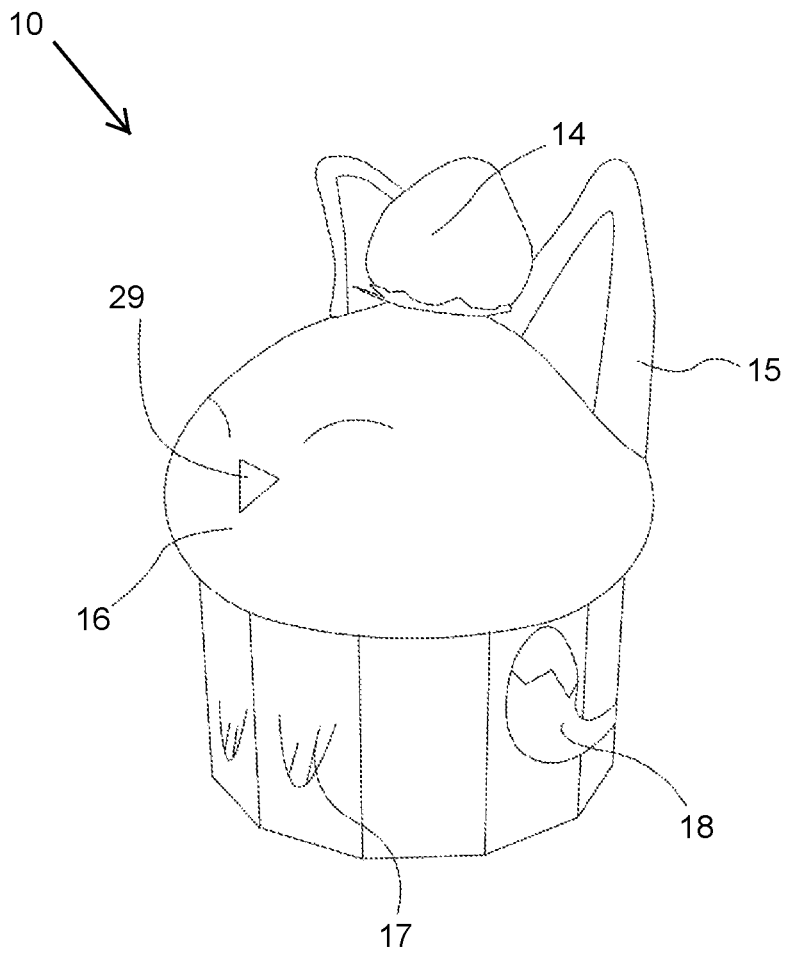
FIG. 4 is a perspective view of a scented toy according to an embodiment of the present disclosure.
Figure 5:
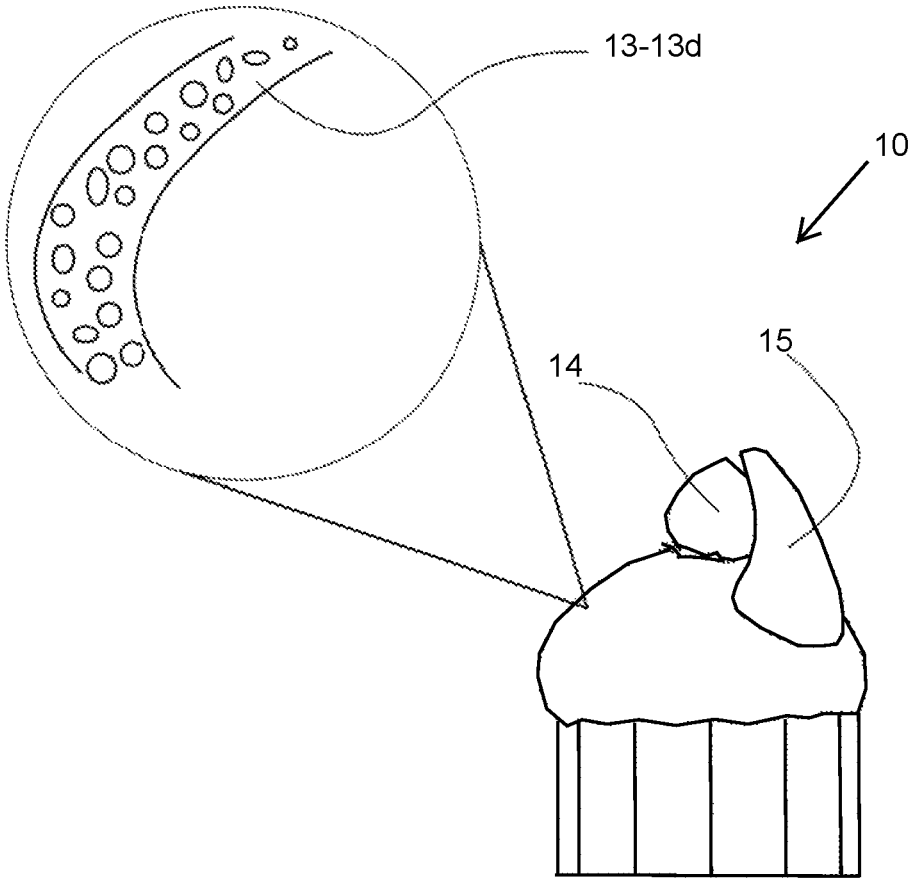
FIG. 5 is a side view of a scented toy comprising a porous material according to an embodiment of the present disclosure.
Figure 6:
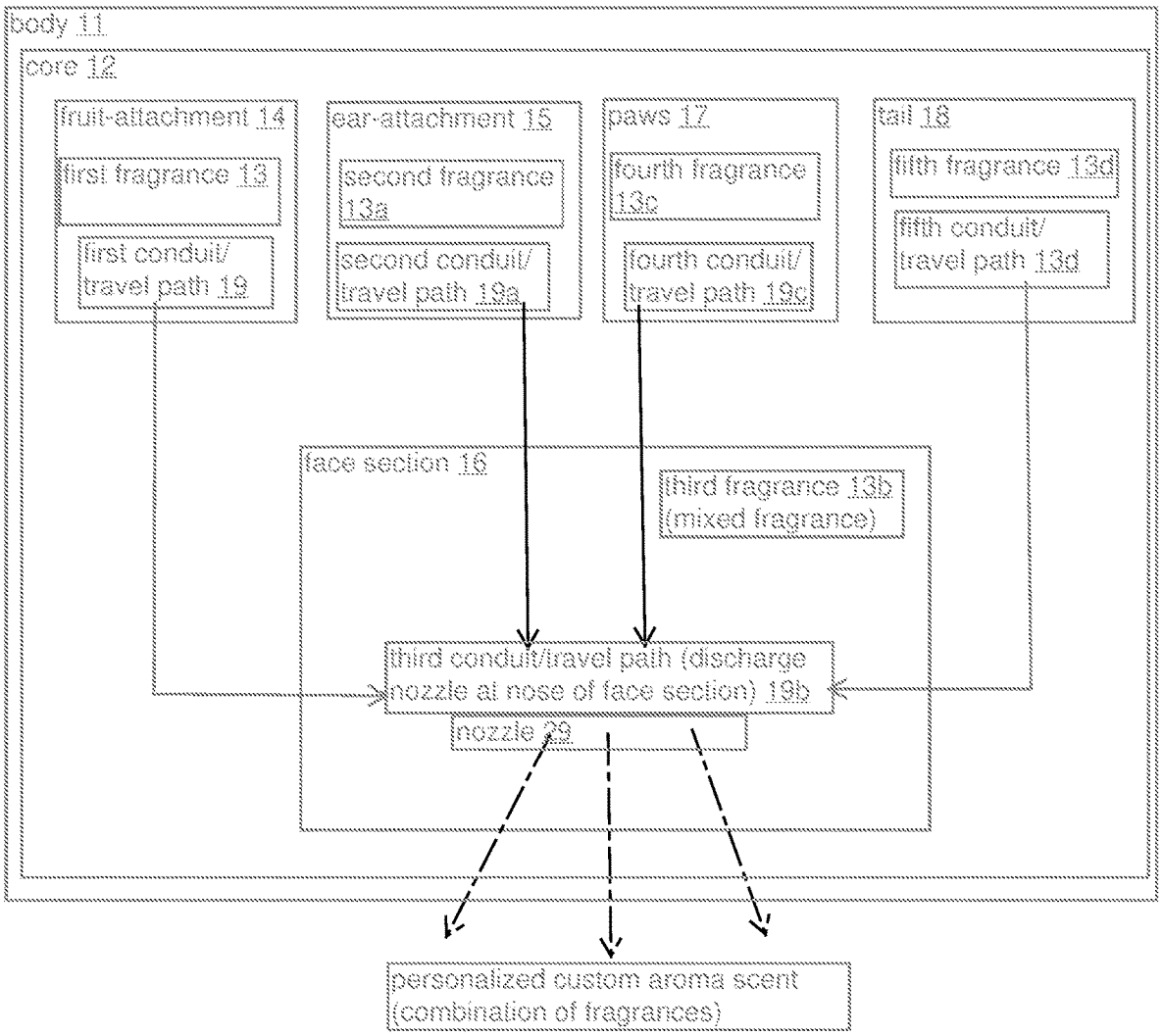
FIG. 6 is a schematic block diagram illustrating the interrelationship between some of the major components of the present disclosure.
Figure 7:
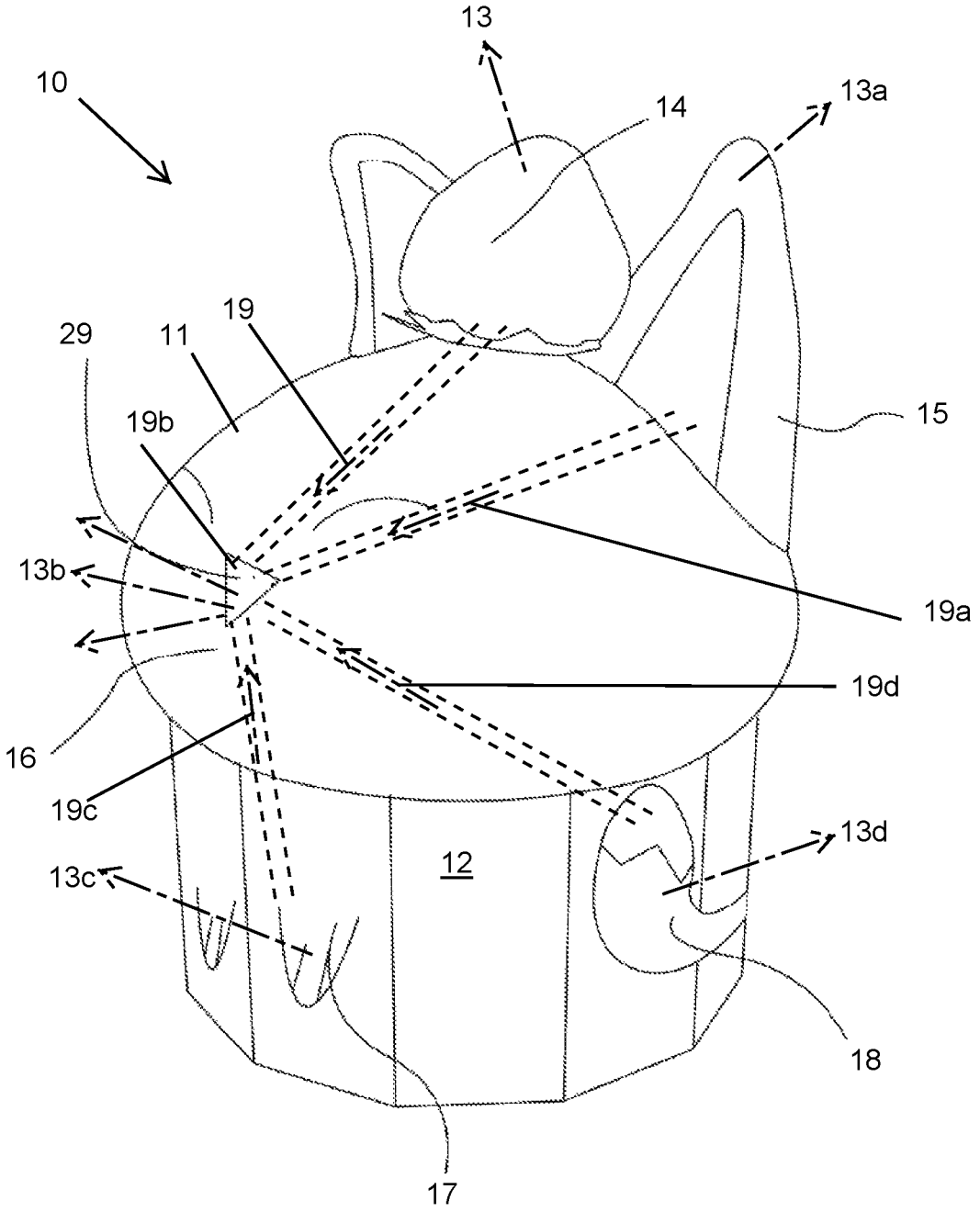
FIG. 7 is a perspective view illustrating the mutually exclusive and non-overlapping fragrance travel paths (conduits, passageways, channels, etc.) for independently delivering fragrances to be mixed at the face section for egress via the nose discharge nozzle.

The non-limiting exemplary embodiment(s) is/are referred to generally in FIGS. 1-7 and is/are intended to provide a scented toy 10 that selectively emits personalized fragrances 13-13*d* mixture a s desired by the user. Referring to FIGS. 1-7, the scented toy 10 for emitting an aromatic scent includes a three-dimensional body 11 having a portable, squishy, micro-porous core 12, the body impregnated with a plurality of fragrances 13-13*d* as well as a muffin-shaped profile. Such fragrances 13-13*d* are compartmentalized within the core 12 and not commingled until they reach the face section 16 for discharge via a nozzle 29 at the nose of the face section 16. The body 11 further has a fruit-attachment 14 communicatively coupled to the core 12 wherein the fruit-attachment 14 is impregnated with a first fragrance 13 of the plurality of fragrances 13-13*d*. Advantageously, the fruit-attachment 14 is configured to emit the first fragrance 13 when squeezed. The body 11 further has an ear-attachment 15 communicatively coupled to the core 12 and spaced apart from the fruit-attachment 14 wherein the ear-attachment 15 is impregnated with a second fragrance 13*a* of the plurality of fragrances 13-13*d*. Advantageously, the ear-attachment 15 is configured to emit the second fragrance 13*a* when squeezed. The body 11 further has a face section 16 communicatively coupled to the core 12 and connected to the fruit-attachment 14 and the ear-attachment 15 wherein the face section 16 is configured to emit a third fragrance 13*b* when squeezed. Advantageously, the third fragrance 13*b* is a mixture of the first fragrance 13 and the second fragrance 13*a*. Notably, each of the fruit-attachment 14, the ear-attachment 15, and the face section 16 is deformably resilient. Such a structural configuration yields the new, useful, and unpredicted result of enabling a user to create a customized desired aroma scent by squeezing one or more of the fruit-attachment 14, and ear-attachment 15 to displace the desired aroma scent (combination of fragrances 13-13*d*) to the face section 16 for egress from the body 11 via nozzle 29. Thus, selected user inputs (squeezing the fruit, ear, tail, paws, etc.) determine the combination of fragrances 13-13*d* to be mixed at the face section 16 for egress from nozzle 29.

In a non-limiting exemplary embodiment, the first fragrance 13 is associated with a fruit scent corresponding to the fruit-attachment 14. Such a structural configuration yields the new, useful, and unpredicted result of providing a predetermined fruit smell associated with the shape of the fruit-attachment 14.

In a non-limiting exemplary embodiment, the body 11 further includes a plurality of paws 17 communicatively coupled to the core 12 and spaced apart from the fruit-attachment 14, and the ear-attachment 15. Advantageously, the plurality of deformably resilient paws 17 are impregnated with a fourth fragrance 13*c* of the plurality of fragrances 13-13*d*. Such a plurality of paws 17 are deformably resilient and configured to emit the fourth fragrance 13*c* when squeezed. Such a structural configuration yields the new, useful, and unpredicted result of enabling a user to create a customized desired aroma scent by squeezing one or more of the fruit-attachment 14, ear-attachment 15, and paws 17. Thus, any combination of the fruit-attachment 14, ear-attachment 15, and paws 17 may be squeezed to customize the desired aroma scent. For example, the fruit-attachment 14 may be squeezed twice, the ear-attachment 15 squeezed once, and the paws 17 squeezed three times, provides a unique and personalized aroma scent, as desired by the user.

In a non-limiting exemplary embodiment, the body 11 further includes a tail 18 communicatively coupled to the core 12 and spaced apart from the fruit-attachment 14, the ear-attachment 15, and the paws 17. Advantageously, the tail 18 is impregnated with a fifth fragrance 13*d* of the plurality of fragrances 13-13*d*, and is deformably resilient and configured to emit the fifth fragrance 13*d* when squeezed. Such a structural configuration yields the new, useful, and unpredicted result of enabling a user to create a customized desired aroma scent by squeezing one or more of the fruit-attachment 14, ear-attachment 15, paws 17, and tail 18. Thus, any combination of the fruit-attachment 14, ear-attachment 15, paws 17, and tail 18 may be squeezed to customize the desired aroma scent. For example, the fruit-attachment 14 may be squeezed once, the ear-attachment 15 squeezed twice, the paws 17 squeezed once, and the tail 18 squeezed twice, provides a unique and personalized aroma scent, as desired by the user.

In a non-limiting exemplary embodiment, the body 11 further has a plurality of travel paths 19-19*d* extending from the fruit-attachment 14, the ear-attachment 15, the paws 17, and the tail 18 to the face section 16 for discharge via nose nozzle 29. Advantageously, the travel paths 19-19*d* are configured to displace the first fragrance 13, the second fragrance 13*a*, the fourth fragrance 13*c*, and the fifth fragrance 13*d* towards the face section 16 for emitting the third fragrance 13*b* (mixture of fragrances) from nose nozzle 29. The nose nozzle 29 is part of the face section 16. Such travel paths 19-19*d* may pass through the core 12 and are mutually exclusive and non-overlapping such that the fragrances 13-13*d* are not mixed prior to reaching the face section 16. Such a structural configuration yields the new, useful, and unpredicted result of succinctly and effectively displacing multiple fragrances 13-13*d* to the face section 16 and mixed thereat for expungement from the body 11 via nose nozzle 29. Advantageously, the fragrances 13-13*d* are not prematurely mixed during their associated travel paths 19-19*d* so the fragrances 13 do not permeate in the core 12 prior to reaching the face section 16. This helps prevent the core 12 from being contaminated with fragrances 13 prior to dissipation from the face section 16.

In a non-limiting exemplary embodiment, when the fruit-attachment 14, ear-attachment 15, paws 17, and tail 18 are squeezed, the associated aroma scents are discharged therefrom, respectively, as well as along the travel paths 19-19*a*, 19*c*-19*d* (ducts, conduits, passageways, etc.) through the core 12 and terminate at the nozzle 29 of the face section 16. Thus, an associated single fragrance 13-13*a*, 13*c*-13*d* is discharged from the fruit-attachment 14, ear-attachment 15, paws 17, and tail 18, respectively, and the mixed fragrance 13*b* is discharged from the nozzle 29 of the face section 16.

The fragrances 13-13*d* move along the travel paths 19-19*d* by air pressure upon squeezing the corresponding region 14-18 of the body 11.

In a non-limiting exemplary embodiment, the second fragrance 13*a* is associated with a non-fruit scent corresponding to the ear-attachment 15. Such a structural configuration yields the new, useful, and unpredicted result of providing a sweet smell associated with the attachment of the body 11.

In a non-limiting exemplary embodiment, each of the first fragrance 13, the second fragrance 13*a*, the fourth fragrance 13*c*, and the fifth fragrance 13*d* has a unique aroma. In this manner, the mixed fragrances (third fragrance) 13*c* further includes the fourth fragrance 13*c* and the fifth fragrance 13*d*. Such a structural configuration yields the new, useful, and unpredicted result of enabling the user to selectively customize the aroma scent by selectively discharging quantities of each fragrances 13-13*d* to the face section 16. When the face section 16 is squeezed the combined aroma scent (containing each fragrances 13 quantity) is discharged from the nose nozzle 29 of the face section 16.

In a non-limiting exemplary embodiment, an alternate mechanism for discharging the fragrances 13-13*d* may be accomplished by the following structure. The body 11 includes a plurality of panels in communication with the porous body 11, and a deformably resilient mesh screen layer communicatively coupled to the panels, the fruit-attachment 14, the ear-attachment 15, the face, the paws 17, and the tail 18. Such a deformably resilient mesh screen layer may be wrapped about the core 12 and is configured to be stretched to a tension position and released to an equilibrium position, respectively. Advantageously, the panels are attached to the mesh screen layer and configured to be selectively open and close, respectively, when the deformably resilient mesh screen layer is stretched to the tension position and released to the equilibrium position, respectively. Advantageously, the plurality of fragrances 13-13*d* are configured to be released and retained via the panels (access doors), respectively, when toggled to the open position and the closed position, respectively. Such a structural configuration yields the new, useful, and unpredicted result of allowing the user to control the fragrances 13-13*d* quantity by squeezing hard or soft for fully or partially opening the discharge panels, respectively.

The present disclosure further includes a method of emitting an aromatic scent from a scented toy 10. Such a method includes the chronological steps of: providing a three-dimensional body 11 including a portable, squishy, micro-porous core 12 impregnated with a plurality of fragrances 13-13*d*, wherein the body 11 has a muffin-shaped profile; providing and communicatively coupling a fruit-attachment 14 to the core 12; providing and communicatively coupling an ear-attachment 15 to the core 12; spacing apart the ear-attachment 15 from the fruit-attachment 14; providing and communicatively coupling a face section 16 to the core 12; and connecting the face section 16 to the fruit-attachment 14 and the ear-attachment 15. Such a specific chronological order of steps yields the new, useful, and unpredicted result of enabling a user to create a customized desired aroma scent by squeezing one or more of the fruit-attachment 14, and ear-attachment 15 to displace the desired aroma scent to the face section 16 for egress from the body 11 via nose nozzle 29.

The method further includes the chronological steps of: impregnating the fruit-attachment 14 with a first fragrance 13 of the plurality of fragrances 13-13*d*; squeezing the fruit-attachment 14 and thereby emitting the first fragrance 13; impregnating the ear-attachment 15 with a second fragrance 13*a* of the plurality of fragrances 13-13*d*; squeezing the ear-attachment 15 and thereby emitting the second fragrance 13*a*; and squeezing the face section 16 and emitting a third fragrance 13*b*. Advantageously, the third fragrance 13*b* is a mixture of the first fragrance 13 and the second fragrance 13*a*, and each of the fruit-attachment 14, the ear-attachment 15, and the face section 16 is deformably resilient. Such a specific chronological order of steps yields the new, useful, and unpredicted result of enabling the user to selectively customize the aroma scent by selectively discharging quantities of each fragrances 13 to the face section 16. When the face section 16 is squeezed the combined aroma scent (containing each fragrances 13 quantity) is discharged from the nose nozzle 29 of the face section 16.

A non-limiting exemplary embodiment(s) of the present disclosure is referred to generally in FIGS. 1-7 and is/are intended to provide a scented toy 10. The scented toy 10 is shown including a 3-dimensional figure provided to emit an aromatic scent. The scented toy 10 comprises a body 11 having a substantially muffin-shaped profile. The body 11 of the scented toy 10 comprises a squishy, micro-porous material impregnated with a non-toxic fragrances 13 including but not limited to a strawberry fragrances 13, a pineapple fragrances 13, and the like. The scented toy 10 is configured to emit the fragrances 13 for a prolonged period. The scented toy 10 may be provided as a kit including a series of the scented toys.

As shown in FIGS. 1-7, the scented toy 10 comprises a substantially muffin-shaped body 11. Each scented toy 10 further includes a fruit-attachment 14 and an ear-attachment 15. The fruit-attachment 14 and the ear-attachment 15 is positioned at a top-portion of each scented toy 10. The fruit-attachment 14 may be provided in a plurality of fruit shapes and the fruit shape preferably corresponds to the non-toxic fragrances 13 of each individual scented toy 10. Additionally, each scented toy 10 includes a printed face, paws 17, and a tail 18.

In a preferred embodiment, the scented toy 10 is provided in a kit having a plurality of configurations of the scented toys 10. A first configuration includes a baby fox, "Strawberry Foxlet", having an infused strawberry fragrances 13. A second version includes a rabbit "Cinnamon Crumb Buns" having a cinnamon fragrances 13. A third configuration includes a cat "Cotton Candy Cat" having a cotton candy scent. In yet another configuration, a seal "Sugar Seal" is provided with a sugar sprinkle fragrances 13. Another configuration includes a panda "Pineapple Panda" having a sweet, citrus aroma of tropical fruit. Lastly, a wolf "Watermelon Wolfie" is provided having a printed face, paws 17, and tail 18 of a wolf.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A scented toy for emitting an aromatic scent, comprising: a three-dimensional body including a squishy, micro-porous core, the body impregnated with a plurality of fragrances;

a fruit-attachment communicatively coupled to said core, wherein said fruit-attachment is impregnated with a first fragrance of said plurality of fragrances;

an ear-attachment communicatively coupled to said core and spaced apart from said fruit-attachment, wherein said ear-attachment is impregnated with a second fragrance of said plurality of fragrances; and a face section communicatively and directly coupled to said core and directly connected to said fruit-attachment and said ear-attachment, wherein said face section is configured to emit a third fragrance when squeezed, wherein said third fragrance is a mixture of said first fragrance and said second fragrance;

wherein each of said fruit-attachment, said ear-attachment, and said face section are deformably resilient wherein said fruit-attachment, when squeezed, is configured to displace said first fragrance to said face section for further egress from said body when said face section is squeezed;

wherein said ear attachment, when squeezed, is configured to displace said second fragrance to said face section for further egress from said body when said face section is squeezed.

2. The scented toy of claim 1, wherein said first fragrance is associated with a fruit scent corresponding to said fruit-attachment.

3. The scented toy of claim 2, wherein said body further comprises:

a plurality of paws communicatively coupled to said core and spaced apart from said fruit-attachment, and said ear-attachment;

wherein said plurality of deformably resilient paws are impregnated with a fourth fragrance of said plurality of fragrances, wherein said plurality of paws are configured to emit said fourth fragrance when squeezed;

wherein said paws are deformably resilient.

4. The scented toy of claim 3, wherein said body further comprises:

a tail communicatively coupled to said core and spaced apart from said fruit-attachment, said ear-attachment, and said paws;

wherein said tail is impregnated with a fifth fragrance of said plurality of fragrances, wherein said tail is configured to emit said fifth fragrance when squeezed;

wherein said tail is deformably resilient.

5. The scented toy of claim 4, wherein said body further has a plurality of travel paths extending from said fruit-attachment, said ear-attachment, said paws, and said tail to said face section, wherein said travel paths are configured to displace said first fragrance, said second fragrance, said fourth fragrance, and said fifth fragrance towards said face section for emitting said third fragrance therefrom, wherein said travel paths are mutually exclusive and non-overlapping.

6. The scented toy of claim 5, wherein said second fragrance is associated with a non-fruit scent corresponding to said ear-attachment.

7. The scented toy of claim 6, wherein each of said first fragrance, said second fragrance, said fourth fragrance, and said fifth fragrance has a unique aroma, wherein said mixture further includes said fourth fragrance and said fifth fragrance.

8. A scented toy for emitting an aromatic scent, comprising: a three-dimensional body including a portable, squishy, micro-porous core, the body impregnated with a plurality of fragrances, said body having a dome-shaped upper section;

a fruit-attachment located at said dome-shaped upper section and being communicatively coupled to said core, wherein said fruit-attachment is impregnated with a first fragrance of said plurality of fragrances;

an ear-attachment located at said dome-shaped upper section and being communicatively coupled to said core and further being spaced apart from said fruit-attachment, wherein said ear-attachment is impregnated with a second fragrance of said plurality of fragrances; and a face section located at said dome-shaped upper section and being communicatively and directly coupled to said core and directly connected to said fruit-attachment and said ear-attachment, wherein said face section is configured to emit a third fragrance when squeezed, wherein said third fragrance is a mixture of said first fragrance and said second fragrance;

wherein each of said fruit-attachment, said ear-attachment, and said face section are deformably resilient wherein said fruit-attachment, when squeezed, is configured to displace said first fragrance to said face section for further egress from said body when said face section is squeezed;

wherein said ear attachment, when squeezed, is configured to displace said second fragrance to said face section for further egress from said body when said face section is squeezed.

9. The scented toy of claim 8, wherein said first fragrance is associated with a fruit scent corresponding to said fruit-attachment.

10. The scented toy of claim 9, wherein said body further comprises:

a plurality of paws communicatively coupled to said core and spaced apart from said fruit-attachment, and said ear-attachment;

wherein said plurality of deformably resilient paws are impregnated with a fourth fragrance of said plurality of fragrances, wherein said plurality of paws are configured to emit said fourth fragrance when squeezed;

wherein said paws are deformably resilient.

11. The scented toy of claim 10, wherein said body further comprises:

a tail communicatively coupled to said core and spaced apart from said fruit-attachment, said ear-attachment, and said paws;

wherein said tail is impregnated with a fifth fragrance of said plurality of fragrances, wherein said tail is configured to emit said fifth fragrance when squeezed;

wherein said tail is deformably resilient.

12. The scented toy of claim 11, wherein said body further has a plurality of travel paths extending from said fruit-attachment, said ear-attachment, said paws, and said tail to said face section, wherein said travel paths are configured to displace said first fragrance, said second fragrance, said fourth fragrance, and said fifth fragrance towards said face section for emitting said third fragrance therefrom, wherein said travel paths are mutually exclusive and non-overlapping.

13. The scented toy of claim 12, wherein said second fragrance is associated with a non-fruit scent corresponding to said ear-attachment.

14. The scented toy of claim 13, wherein each of said first fragrance, said second fragrance, said fourth fragrance, and said fifth fragrance has a unique aroma, wherein said mixture further includes said fourth fragrance and said fifth fragrance.

* * * * *